US005127566A

United States Patent [19]

Beletsky

[11] Patent Number: 5,127,566

[45] Date of Patent: Jul. 7, 1992

[54] SECURITY HOLSTER THUMB-BREAK

[75] Inventor: Robert J. Beletsky, Rockport, Mass.

[73] Assignee: Strong Holster Co., Gloucester, Mass.

[21] Appl. No.: 685,995

[22] Filed: Apr. 12, 1991

Related U.S. Application Data

[63] Continuation of Ser. No. 420,144, Oct. 11, 1989, abandoned.

[51] Int. Cl.[5] ..... F41C 33/02

[52] U.S. Cl. ..... 224/243; 224/911

[58] Field of Search ..... 224/243, 242, 246, 911; 24/663, 590, 591, 597, 649, 701, 589, 697

[56] References Cited

U.S. PATENT DOCUMENTS

| | | | |
|---|---|---|---|
| Re. 30,139 | 11/1979 | Jones | 224/243 |
| 3,911,537 | 10/1975 | Mazur | 24/590 |
| 4,286,741 | 9/1981 | Rogers | 224/243 |
| 4,694,980 | 9/1987 | Rogers | 224/238 |
| 4,750,655 | 6/1988 | Barry | 224/243 |

*Primary Examiner*—Linda J. Sholl

*Attorney, Agent, or Firm*—Brian M. Dingman

[57] ABSTRACT

An assembly for releasably securing a holster safety strap including a fastening device for fastening the safety strap to the holster and a securing device for the fastening device pivotable between a first, unlocking position and a second, security position; the securing device in the second position inhibiting operation of the fastening device and in the first position allowing normal operation of the fastening device to provide additional security in a holster safety strap.

24 Claims, 5 Drawing Sheets

SECURITY HOLSTER THUMB-BREAK

This is a continuation of application Ser. No. 420,144, filed Oct. 11, 1989, now abandoned.

FIELD OF INVENTION

This invention relates to a security holster and more particularly to an improved thumb-break style holster in which the thumb-break is the secondary restraint.

BACKGROUND OF INVENTION

Holster designs have evolved quickly in recent years due to safety concerns for the wearer. The first holsters were simply open pouches in which the handgun could be withdrawn in a single motion. These open pouch designs had no means of securing the handgun in the holster to prevent inadvertent or adversarial withdrawal. In response to concerns for wearer safety, holsters with a single security device were developed. Typically, the security device included a strap spanning the open holster pouch and provisionally secured to the holster with a snap. The strap prevented withdrawal of the gun until unsnapped.

A more advanced form of this single security holster design is the common thumb-break holster in which the strap is snapped to the raised inside top edge of the holster, which takes the form of a tab extending from the pouch. This allows the snap to be unfastened with the wearer's thumb to provide quick and easy access to the handgun. However, the thumb-break could also be opened just as easily by an adversary, who could simply reach in from behind the wearer, unsnap the strap and withdraw the gun from the rear.

In recent years there have been many attempts to provide additional security in thumb-break style holsters for preventing unwanted handgun withdrawal. These holster designs have typically added a second level of security which inhibits in some manner handgun withdrawal after the strap is opened. Most designs have added as a second level of security some form of holster tension to inhibit gun withdrawal. In one solution, a strap was added across the rear of the pouch opening to cover the revolver trigger guard. This prevents the gun from being withdrawn from the rear. The front of the pouch is then slit to allow the gun to be pushed forward and out and up through the front section of the holster. Typically, a spring member is sewn into the pouch surrounding the slit to provide a tension which must be overcome to withdraw the gun.

The advantage of this holster design was that the gun had to be pushed forward and up to be removed; an adversary had to be standing in front of the wearer to remove the gun, which allowed the wearer additional time to react. However, these holsters suffer from a number of drawbacks which have prevented them from being universally accepted as providing sufficient security. First, the thumb-break is the only actual positive security device. The secondary security device is simply the holster spring tension in combination with the requirement of forward gun motion. Thus, once the primary device is defeated, there is a possibility of inadvertent gun withdrawal. Another drawback is the requirement of providing holster tension. Typically, holsters are leather and the tension is provided by sewing a strong spring into the pouch. However, this requires much additional expense and labor in manufacturing the holster. Also, the springs are typically quite stiff when new and must be worked in until they have enough give to allow the wearer to withdraw the gun in a comfortable fashion. As the holster is used, the spring continues to wear, providing less and less security. In relying on spring tension as the secondary device, these holsters will eventually wear and have to be replaced.

Another problem the spring tension thumb-break holsters is that the holster must typically be worn so the pouch is vertical to allow the wearer to relatively easily remove the gun with the forward and up movement required. However, the Federal Bureau of Investigation has determined after much study that a slight forward holster cant or rake of approximately thirteen degrees from vertical is the ideal holster position, primarily to ensure that the wearer leans forward into a crouching position as the gun is drawn, an also for deterring withdrawal from the rear. With the spring tension thumb-break holster, if the pouch is raked or canted forward, the forward and up removal motion becomes awkward and difficult to accomplish quickly; the forward motion would become almost a downward motion which would be clumsy and could potentially lead to situations in which the handgun could not be withdrawn quickly enough. Thus, those holsters can not be worn in the safest and most secure manner.

Another problem with the spring tension thumb-break style holsters has been created by the recent trend of security forces carrying semi-automatic pistols. Typically, the semi-automatics have a flat trigger guard which can not be held in place with the trigger guard strap used in revolver holsters. One solution to this problem has been to employ a protruding member built into the holster pocket positioned to rest inside the trigger guard when the pistol is placed in the holster. The protruding member is positioned to prevent vertical or rearward withdrawal; the handgun must be pushed forward and up to withdraw, much as in the handgun holsters. However, the protruding member adds greatly to the complexity of the holster and may also be a security hazard, as it rests inside of the trigger guard. By having a protruding member adjacent the trigger, there is always the possibility that the gun could be jostled enough to press the trigger against the protruding member and fire the gun while in the holster. Thus, there exists a need for more secure double security thumb-break style holster for semi-automatic pistols.

SUMMARY OF INVENTION

It is therefore an object of this invention to provide an improved thumb-break holster which includes two distinct levels of positive restraint.

It is a further object of this invention to provide such a holster in which the thumb-break is the second level of restraint.

It is a further object of this invention to provide such a holster in which the primary means of restraint is a positive locking restraint.

It is a further object of this invention to provide such a holster which may be used for both revolvers and semi-automatic pistols.

It is a further object of this invention to provide such a holster which does not require a holster tension device.

It is a further object of this invention to provide such a holster which is not subjected to great stress on handgun withdrawal.

It is a further object of this invention to provide such a holster which is relatively simple and inexpensive to manufacture.

It is a further object of this invention to provide such a holster which allows the holster pouch to be raked forward.

It is a further object of this invention to provide such a holster in which the pouch is relatively light weight.

It is a further object of this invention to provide such a holster in which handgun removal requires removal action in two axes to inhibit inadvertent or unwanted withdrawal.

It is a further object of this invention to provide such a holster in which the releasable safety strap is more positively held in place.

It is a further object of this invention to provide such a holster in which the safety strap is fastened with a locking device.

This invention results from the realization that thumb-break style holsters can be dramatically improved by providing a primary restraint which must be opened with a motion in one axis to allow the thumb-break to be opened with a motion in a second axis.

This invention features an assembly for releasably securing a holster safety strap including means for releasably fastening the safety strap to the holster and means for securing the means for releasably fastening pivotable between a first, unlocking position and a second, security position, in which the means for securing in the second position inhibits operation of the means for releasably fastening and in the first position allows normal operation of the means for releasably fastening to provide additional security in a holster safety strap. Preferably, the means for releasably fastening includes an engaging member on one of the strap and the holster and a receiving structure on the other of the strap and holster. There may be further included means for locking the means for securing in the second position to prevent pivoting to the first position to lock the gun in the holster.

The means for securing may include a protruding member pivotably fastened to one of the strap and holster. Preferably, the protruding member is fastened to the holster. One of the engaging member and the receiving structure may be integrally included in the protruding member.

Preferably, the means for releasably fastening is a snap assembly including a snap head engaging member and a socket receiving structure. In that case, the snap head preferably includes a protruding shank with an enlarged distal end, which may include at least one flat section. The socket may include at least one protruding tab for preventing engagement of the distal end unless the flat is aligned with the tab. Preferably, the flat is aligned with the tab when the means for securing is in the first position.

In an alternative embodiment, the engaging member and the receiving structure may have complementary shapes for engaging when aligned. The engaging member may include a protruding pin with an enlarged distal end, in which case the receiving structure may include a hole through the protruding member slightly smaller than the enlarged distal end for frictionally fitting the distal end. In that case, there is preferably further included an arc-shaped slot through the tab member contiguous with the hole for engaging the pin. Preferably, the slot is more narrow than the width of the distal end for preventing withdrawal of the engaging member from the receiving structure when the distal end is not aligned with the hole.

The enlarged distal end of the pin may be generally circular. Preferably, the assembly further includes means for defining the first position, which may include stop means on at least one of the holster and the safety strap for engaging the means for securing in the first position. Preferably as well, the means for securing and the means for releasably fastening are operable in distinct directions.

In a preferred embodiment, the security thumb-break assembly includes an actuating member protruding from the holster pivotable between a substantially vertical position and a partially rotated position. Further included is a snap fastener having a protruding engaging portion and a receiving portion, one of the portions on the actuating member and the other on the safety strap adjacent the actuating member. The engaging portion includes a shank with an enlarged distal end having at least one flattened portion, and the receiving portion includes a substantially annular socket having at least one tab protruding inwardly from the socket to allow the engaging portion to engage the socket only when the flat portion is aligned with the tab, which occurs when the actuating member is in the substantially vertical position so that the fastener may be released by the wearer's thumb. The tab on the socket engages under the enlarged distal end when the snap fastener is engaged and the actuating member at least partially rotated to inhibit release of the fastener for providing additional security in a holster safety strap.

This invention also features a security assembly for releasably securing a handgun in a top-opening holster pocket including a safety strap pivotably fastenable to both sides of the holster pocket pivotable from a first security position spanning the opening to inhibit removal of the handgun from the holster pocket to a second position substantially free of the opening. Further included are means for releasably fastening the safety strap when in the first position to the holster pocket to prevent the strap from pivoting to the second position. The invention also contemplates a security safety-strap holster including the security assembly described.

DISCLOSURE OF PREFERRED EMBODIMENT

Other objects, features and advantages will occur to one skilled in the art from the following description of preferred embodiment and the accompanying drawings in which.

This invention may be accomplished in a security thumb-break holster with two restraints; the first released by a movement in one direction, and the second being a thumb-break released by movement in a second direction.

Figure 1A:
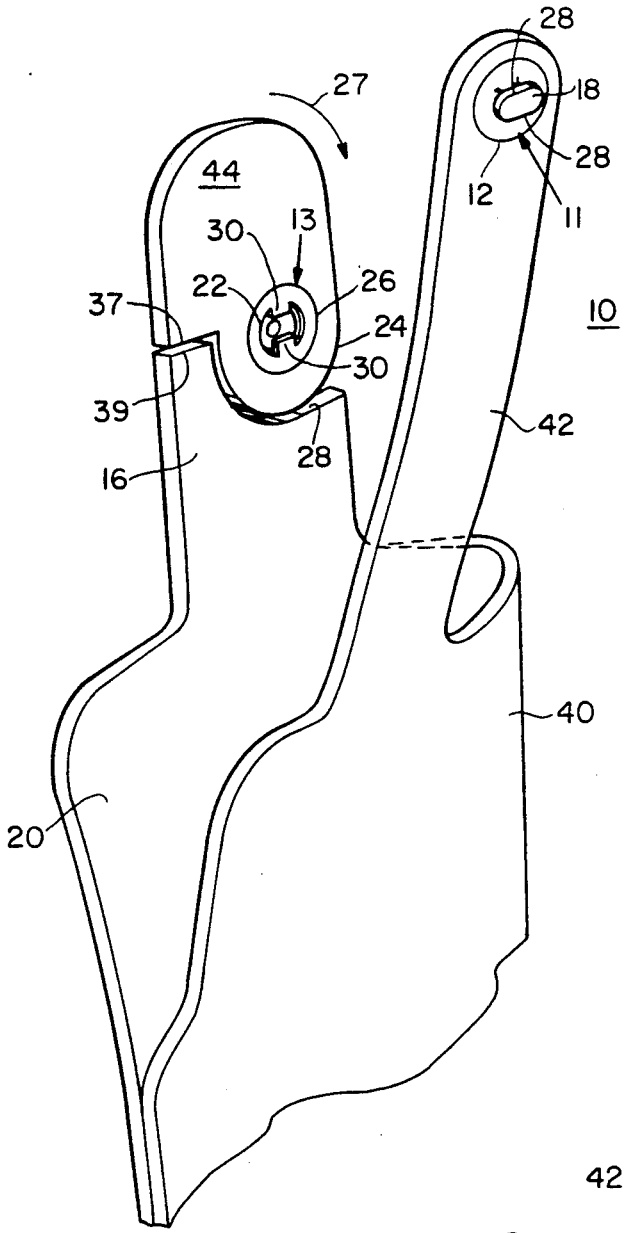
FIG. 1A is an axonometric view of a security thumb-break according to this invention on an open-top holster.

There is shown in FIG. 1A security thumb-break 10 according to this invention, mounted on open pouch 40 with rear opening 20 for accommodating the handgun trigger guard. Safety strap 42 is shown in the opened or unfastened position. In the ready position, with a single restraint in place, strap 42 is folded over across the opening in pouch 40, and protruding snap member 11 engages receiving snap member 13. Snap member 11 includes eyelet 12 and protruding stud 18 with flats 28 on its enlarged distal end. Snap member 13 includes socket member 26 with receiving socket 22 for receiving stud 18. Socket 22 includes inwardly-protruding tab members 30 which align with flats 28 in the position shown.

Rotating pivot member 44 is attached to holster section 16 and pivots forward on socket 22 in the direction of arrow 27. In use, strap 42 is folded over the gun, not shown, and snap member 11 fitted into snap member 13. Pivot member 44 is then pivoted forward 90° in the direction of arrow 27, at which point forward section 24 contacts holster section 28 to provide a positive stop for pivot member 44. In the pivoted or double-restraint position, protruding members 30 rest under the protruding lobes between flats 28 of stud 18, as is more fully described below, for preventing the snap from being unfastened. To release the handgun, pivot member 44 is pivoted back to the vertical position at which point the holster becomes the equivalent of a typical thumb-break style holster. Portion 37 contacts portion 39 to define the ready or single-restraint position. Thus, the rotating security snap assembly provides an additional positive security or restraint measure which must be unsecured before the thumb-break is even operational.

This forward-rotating snap-restraint assembly inhibits withdrawal of the gun from the rear, as pivot member 44 is facing forward in the double-restraint position. Security is also provided by the two-step, two-axis movement required to unfasten strap 42 from member 44; the backward rotational and then unsnapping action requires two distinct movements which are less likely to inadvertently occur than the single unsnapping action of the typical thumb-break holsters.

It should be understood that it is not necessary to include two flats and tabs as illustrated; one would suffice to prevent snap disengagement in at least one direction when the security device is rotated. In such an arrangement, a second security device, not shown, could be employed to prevent disengagement from any direction in the double-security position. It should also be understood that there are numerous other devices which could be employed to accomplish the pivoting security device for a thumb-break style holster according to this invention; several of those alternative devices are discussed below.

Security thumb-break 10 also allows pocket 40 to be made as a simple pouch; there is no need for the front opening surrounded by a spring member as is employed in the existing thumb-break security holsters. In addition, there is no need for the rear trigger guard strap found in those security holsters. As a result, holster 10 is extremely simple and inexpensive to manufacture while providing more positive security than exists in current holster designs.

Figure 1B:
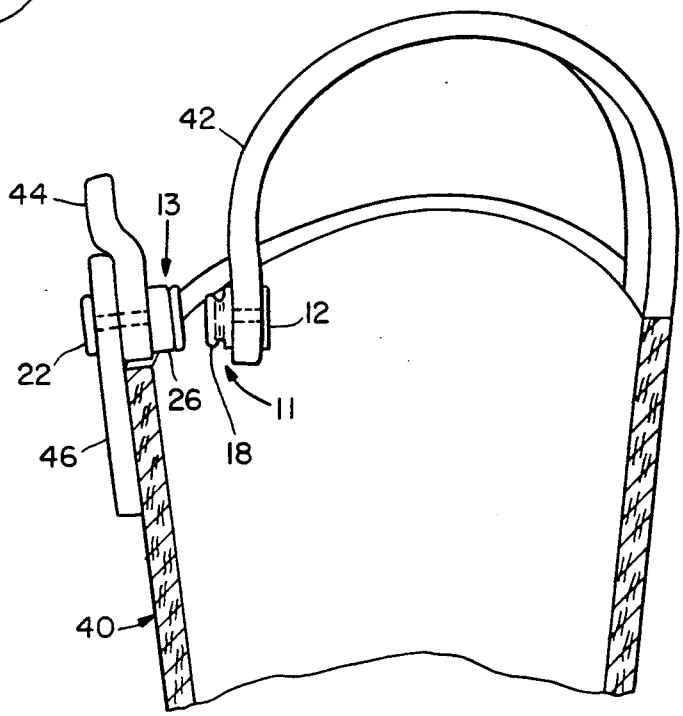
FIG. 1B is rear elevational partly crossed-sectional view of the holster of FIG. 1A.

The snap member of the security device according to this invention is shown in more detail in FIG. 1B. Socket 26 accepts the distal end of stud 18, secured to strap 42 by eyelet 12. Similarly, eyelet 22 secures socket 26 to rotating member 44, which pivots on eyelet 22. Protruding holster portion 46 provides a means of securing eyelet 22 to holster 40 for allowing member 44 to pivot thereon.

Figure 1C:
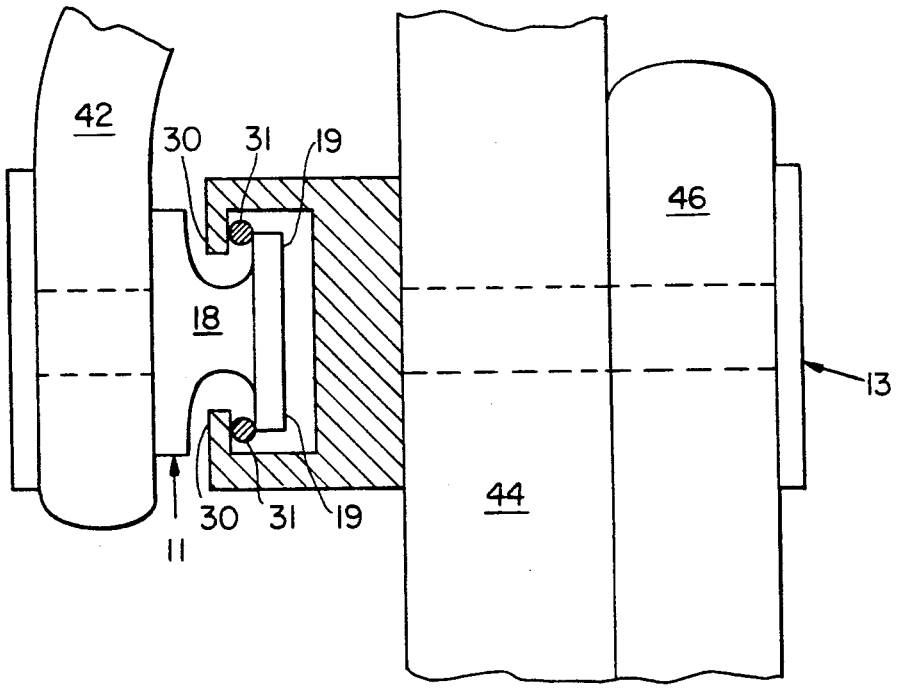
FIG. 1C is a greatly enlarged, schematic, partly cross-sectional diagram of the security snap of the holster of FIG. 1A in the secure position.
Figure 1D:
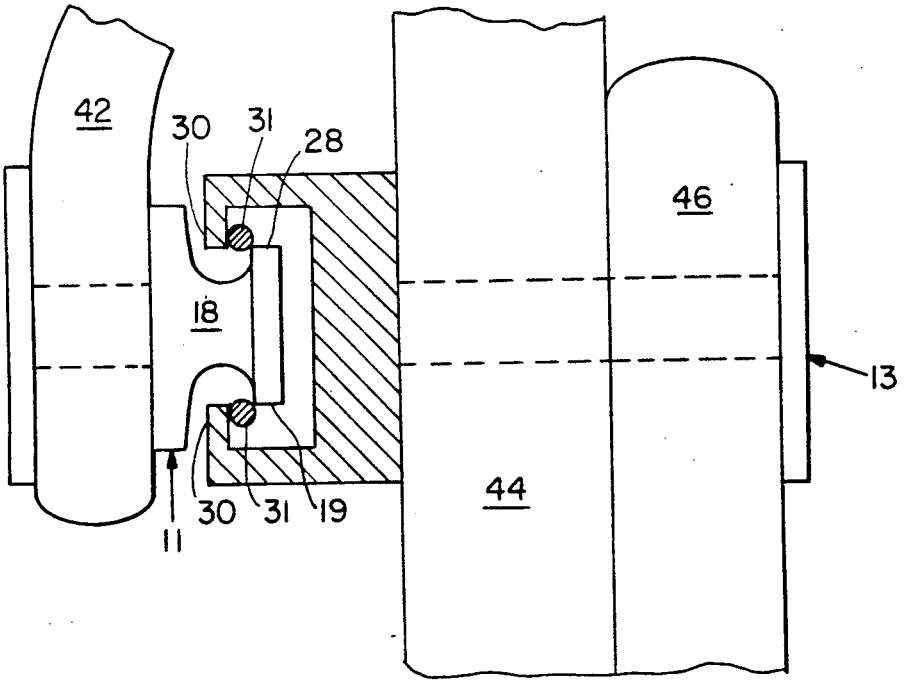
FIG. 1D is a greatly enlarged, schematic diagram of the snap of FIG. 1C in the ready position.

The releasable security feature of assembly of FIG. 1B is shown in more detail in FIGS. 1C and 1D, which depict the device in the double-restraint and ready positions, respectively. In the double-restraint position, FIG. 1C, protruding tabs 30 protrude under protruding lobes 19 of stud 18 to prevent the snap from being disengaged. Snap ring 31, in cross-section, is fitted under rim 30 of socket 26 as it is known in the art. FIG. 1D shows the snap in the ready or unsecured position in which stud flats 28 are aligned with protruding tabs 30 to allow snap members to be disengaged; in this position, after the primary security device has been disengaged, the holster is the equivalent of a typical thumb-break style holster, where snap-ring 31 is the only structure preventing the snap from disengaging.

Figure 1E:
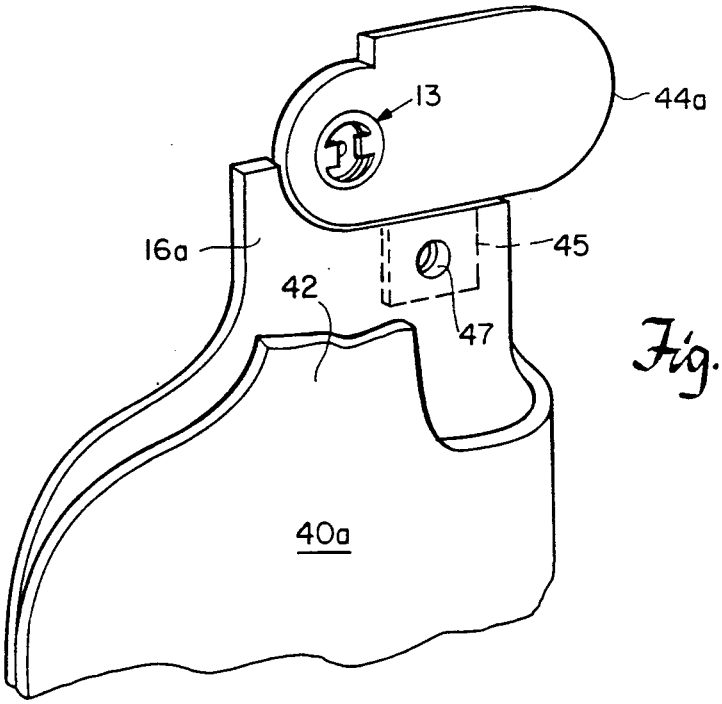
FIG. 1E is a partial schematic view of a means of locking the security thumb-break of FIG. 1A in the security position.

FIG. 1E illustrates a simple embodiment of the means of locking pivot member **44*a* in the double restraint or security position to prevent its movement back to the single security position shown in FIG. 1A. Such a locking feature would be especially useful when the holster is not being worn, for example when it is in an officer's storage locker. Preferably, such a locking device includes any of the known key operated or device operated locks which would allow them to be opened only by the officer possessing the key or device needed to unlock the lock. In the embodiment of FIG. 1E, pivot member 44*a* includes protruding section 45 which rests behind section 16*a* of holster 40*a* in the double security position shown. Portions 16*a* and 45 have hole 47 therethrough which are aligned in the position shown to allow a padlock or other locking device, not shown, to fit therethrough. Such a locking structure would prevent member 44*a* from pivoting back to the vertical, single security position and thus would prevent the handgun, not shown, from being removed from holster 40*a*. It should be understood that the invention encompasses the provision of any of the locking devices known in the art which may be built directly into the holster to accomplish the locking of pivot member 44*a* in the double security position. It is simply necessary to accomplish a locking device which is activated or locked only by some positive action taken by the wearer, for example by the use of a key or the addition of a padlock in the embodiment shown. The locking device thus prevents pivot member 44*a*** from inadvertently locking when the wearer needed to withdraw the gun.

Figure 2:
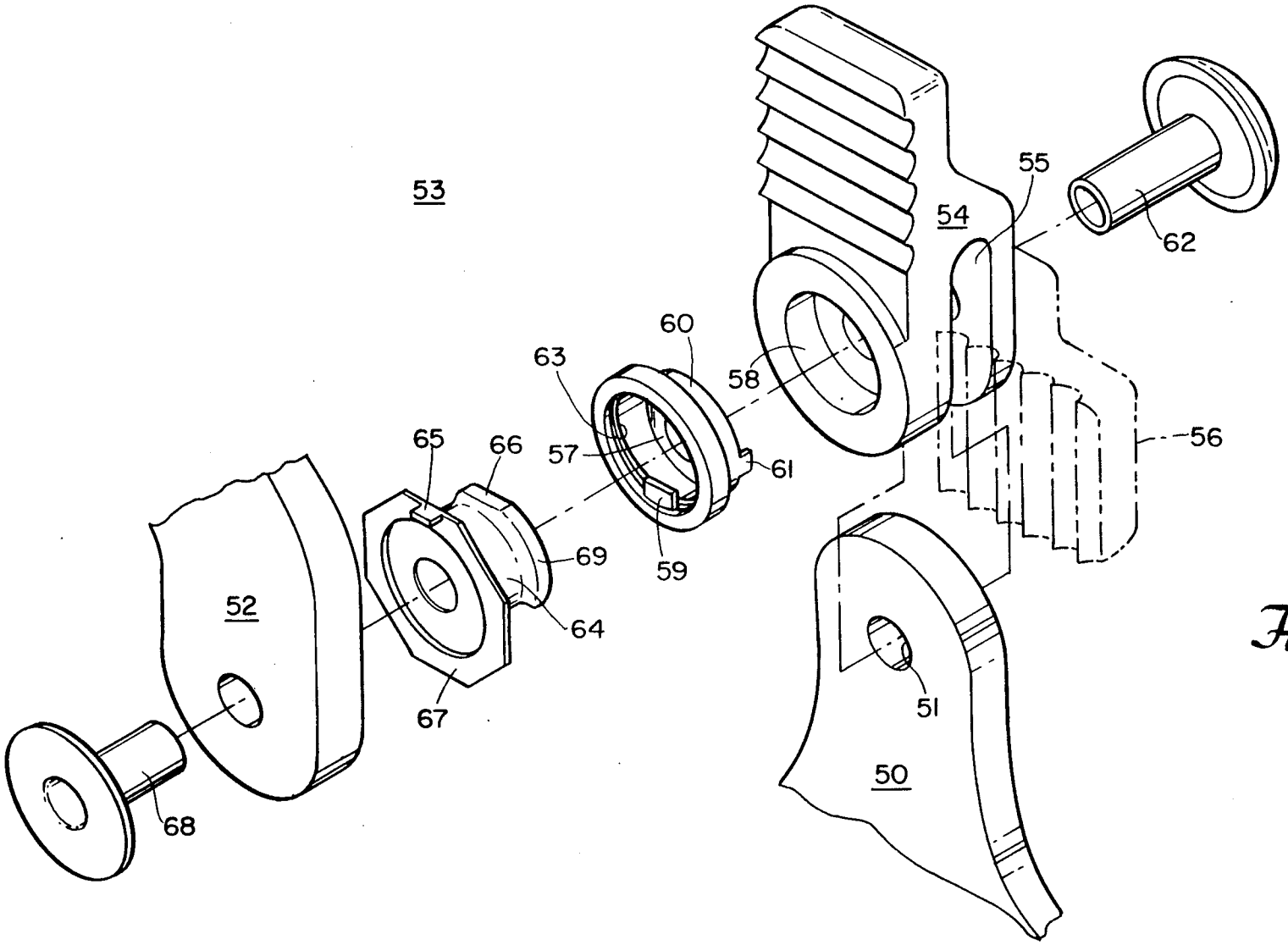
FIG. 2 is an exploded axonometric view of an alternative security thumb-break for a holster according to this invention.

FIG. 2 illustrates in detail thumb-break swivel security device 53 according to this invention, which may be used on a standard thumb-break in place of the standard snap assembly. Swivel member 54 may be made of metal or plastic, for example, and includes slot 55 sized to fit over thumb-break tab 50 of any thumb-break style holster. In typical thumb-break holsters, the snap assembly would fit through hole 51. Forward slot 55 allows member 59 to pivot forward up to 90° to security position 56, in phantom, more fully described below. The rear section of member 54 is not slotted, and rests against tab 50 in the ready position shown, to automatically align tabs 59 with flats 66, as described below.

Socket member 60 is fitted in hole 58 and includes tab key 61 which penetrates swivel member 54 to prevent socket 60 from rotating in hole 58. Button 62 passes through hole 58 and is peened over against base 57 to hold socket 60 in swivel 54 and also to hold swivel 54 on tab section 50. Likewise, eyelet 68 is employed to hold stud member 67 on holster safety strap 52. Member 67 includes tab key 65 for preventing rotation on strap 52. Protruding stud 64 has flats 66, only one shown, for decreasing the diameter of head 69 to allow protruding tabs 59, only one shown, in socket member 60 to engage behind head 69. When the snap is engaged and swivel member 54 pivoted to security position 56, shown in dashed line, tab members 59 lock behind the large lobes of head 69 to prevent the snap from being disengaged. In the ready position shown in FIG. 2, snap ring 63 retains stud 64 in socket 60.

Figure 3A:
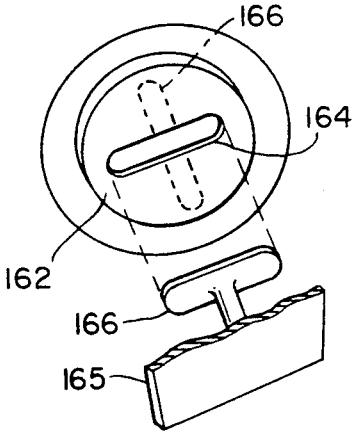
FIGS. 3A and 3B are axonometric and cross-sectional views of an alternative fastener for the security device according to this invention.
Figure 3B:
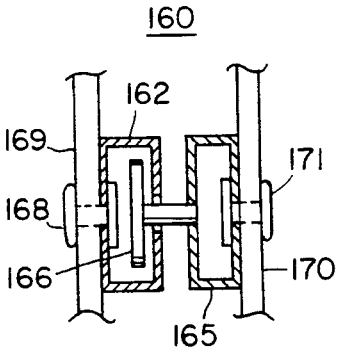

It should be understood that the embodiment shown in FIG. 2, with the snap socket member on the protruding swivel member and having protruding tabs fitting over flats in the snap head, are not necessary limitations of this invention. Alternatively, in a device with a snap security device the snap socket member could be on the safety strap and could engage with the snap head member in a different manner. For example, as shown in FIGS. 3A and 3B, snap 160 may include snap head 165 with elongated oval-shaped head 166, and snap socket 162 may have similarly oval-shaped hole 164 which allows head 166 to pass therethrough. When snap head 165 or socket 162 is rotated, elongated head 166 is held in the socket in the position shown in phantom to prevent withdrawal until the head and socket opening are again aligned.

FIG. 3B shows snap 160 in cross section, and illustrates that snap head 165 is attached to holster or safety strap 170 with stud 171. Likewise, socket 162 is attached to the other of holster or safety strap 169 by stud 168. One of snap head 165 or socket 162 is rotatable, preferably accomplished by attachment to a portion of the holster or strap which is itself rotatable.

Figure 3C:
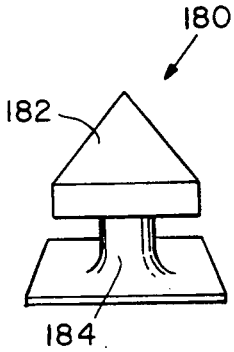
FIG. 3C is a simplified view of an alternative head shape for a snap fastener for the security device according to this invention.

The snap assemblies and head and socket shapes shown are not limitations of the present invention. It is important only that the fastener stud portion have an enlarged head with an overhang and the socket portion have a similarly shaped receiving section which allows the head to be passed therethrough. As long as the head has at least one protrusion which, when rotated in the socket is held underneath the face of the socket, the rotational securing of the fastening device according to this invention may be accomplished. Another alternative shape for illustration purposes is shown in FIG. 3C, in which snap head 180 includes triangular enlarged head 182 attached to the distal end of stud 184. It can be seen that with such a triangular shaped head, and employing a socket with a similarly shaped opening, even a slight rotation of well under 90° would securely lock the two snap pieces together.

Figure 4A:
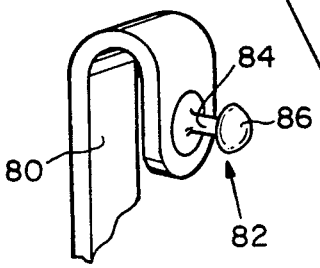
FIGS. 4A and 4B are axonometric views of yet another alternative holster security device according to this invention.
Figure 4B:
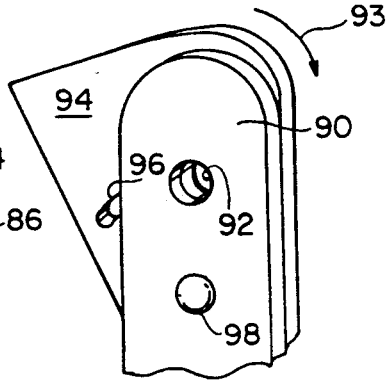
Figure 4C:
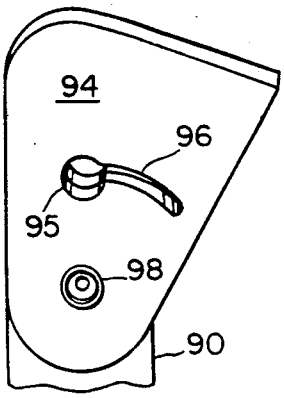
FIG. 4C is a rear elevational view of the device of FIG. 4B.

FIGS. 4A through 4C illustrate another alternative swivel-type security thumb-break according to this invention including pin member 82 secured to safety strap 80 and having elongated neck 84 with enlarged distal end 86. Swivel member 94 is attached holster 90 by swivelling stud or rivet 98. Holster 90 and member 94 have a hole 92 and 95, respectively, therethrough, which is preferably sized slightly smaller than enlarged head 86 for frictionally fitting head 86 therethrough. In that case, holster 90 and member 94 are preferably made from a material such as leather which has enough give to repeatedly allow head 86 to pass through without substantial stretching. Neck 84 is long enough to pass through holster 90 and swivel member 94, so that in the engaged position head 86 is passed entirely through holes 92 and 95.

In the rear view of FIG. 4C swivel member 94 can be seen in greater detail and includes integral arc-shaped slot 96. In use, pin 82 would be pressed through holes 92 and 95 in the unsecured or ready position shown. Member 94 would then be rotated forward in the direction of arrow 93 so that hole 95 is no longer aligned with hole 92; elongated neck 84 would rest in slot 96. Since slot 96 is not as wide as head 86, pin 82 may not be removed until member 94 is swivelled back to the vertical position in which hole 92 is aligned with hole 95. In this unsecured or ready position, the device would be the equivalent of a thumb-break in that enlarged head 86 would have to be pulled through holes 95 and 92 to disengage safety strap 80 from holster 90.

Figure 5A:
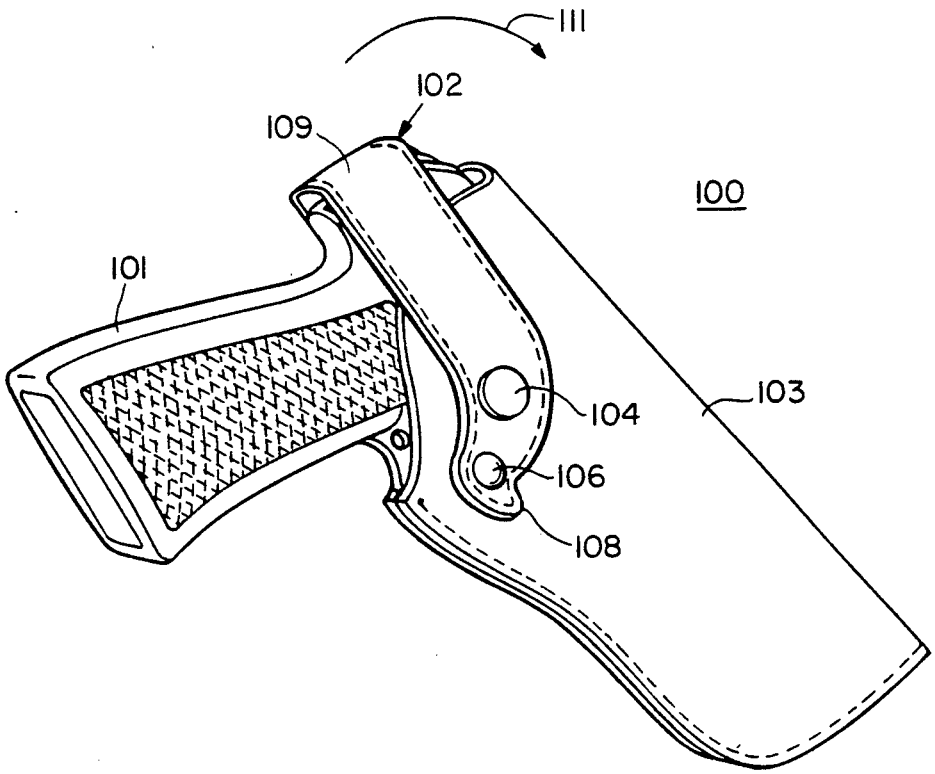
FIGS. 5A and 5B are simplified axonometric views of an alternative thumb-break style security device according to this invention in the secure and open position, respectively.
Figure 5B:
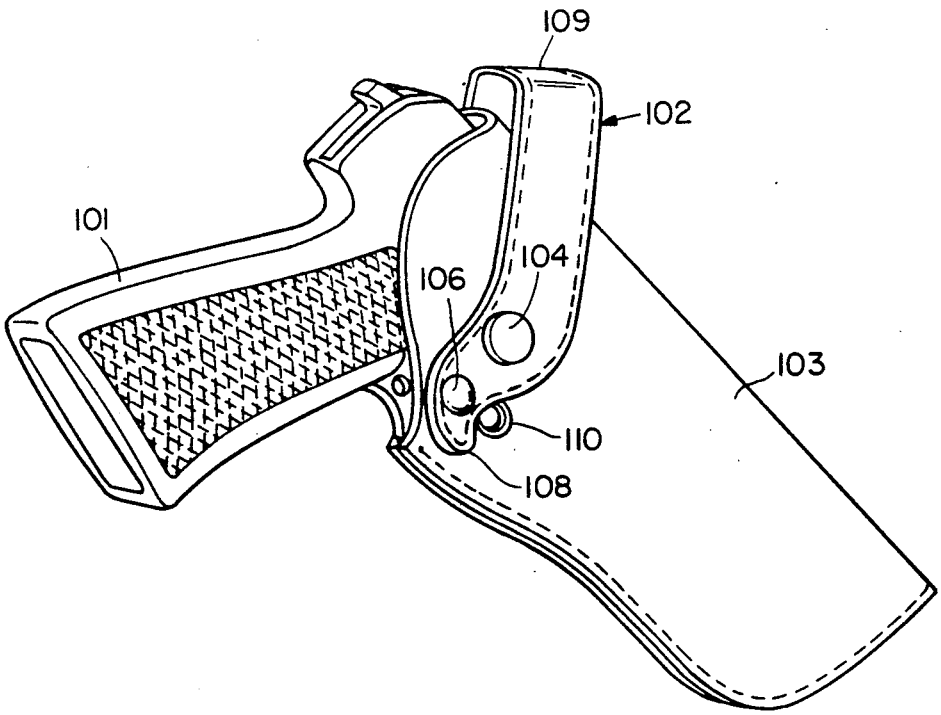

An alternative pivoting two-step security device according to this invention is shown in FIGS. 5A and 5B Holster 100 includes safety strap 102 permanently secured to opposite sides of pouch 103 by two swivelling rivet members 104, only one shown. Strap 102 includes angular protruding section 108 with snap member 106, which engages a second snap member 110, FIG. 5B, attached to pouch 103 for securing strap 102 to prevent its movement in the double-restraint position, FIG. 5A. To release gun 101 from pouch 103, snap member 106 is disengaged from snap member 110, and strap 102 is rotated forward in the direction of arrow 111 to free handgun 101 for removal.

The two step security device of FIGS. 5A and 5B provides a thumb-break style holster in which two axis movement is required to free the gun from the holster. The first movement is an unsnapping action in which tab 108 is pulled away from holster pocket 103 to release snap 106. The second motion is a forward pivoting motion of strap 102 which may be accomplished by pulling straight up on tab 108 or by pushing forward on upper portion 109 of strap 102. In either case, the security device requires two separate movements in two separate axes to free the gun from the holster, which greatly decreases the chance of inadvertent or unwanted withdrawal of the gun from the holster.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. An assembly for releasably securing a holster safety strap to a holster, comprising:

a securing device pivotably attached to one of the strap and the holster; and means for releasably fastening the safety strap to the holster; said means for releasably fastening comprising a first fastener member affixed to the strap and a second fastener member, engageable with said first fastener member, affixed to said securing device; said first and second fastener members being relatively rotatable when engaged; said securing device further being pivotable between a first, unlocking position and a second, securing position; said securing device in said first position, allowing the disengagement of said fastener members; and said securing device in said second position, with said fastener members having been relatively rotated from an engagement position, inhibiting disengagement of said fastener members, to provide additional security in a holster safety strap.

2. The assembly of claim 1 in which said means for releasably fastening includes an engaging member and a receiving structure.

3. The assembly of claim 2 in which said securing device is pivotably fastened to the holster.

4. The assembly of claim 3 in which one of said engaging member and said receiving structure is integral with said securing device.

5. The assembly of claim 2 in which said means for releasably fastening is a snap assembly including a snap head engaging member and a socket receiving structure.

6. The assembly of claim 5 in which said snap head includes a protruding shank with an enlarged distal end.

7. The assembly of claim 7 in which said distal end includes at least one flat section.

8. The assembly of claim 7 in which said end socket includes at least one protruding tab for preventing engagement of said distal end unless said flat section is aligned with said tab.

9. The assembly of claim 8 in which said flat section is aligned with said tab when said means for securing is in said first position.

10. The assembly of claim 3 in which said engaging member and said receiving structure have complementary shapes for engaging when aligned.

11. The assembly of claim 10 in which said engaging member includes a protruding pin with an enlarged distal end.

12. The assembly of claim 11 in which said receiving structure includes a hole through said protruding member slightly smaller than said enlarged distal end for frictionally fitting said distal end.

13. The assembly of claim 12 in which said receiving structure further includes an arc-shaped slot through said tab member contiguous with said hole for engaging said pin.

14. The assembly of claim 13 in which said slot is more narrow than the width of said distal end for preventing withdrawal of said engaging member from said receiving structure when said distal end is not aligned with said hole.

15. The assembly of claim 10 in which said shape is generally polygonal.

16. The assembly of claim 10 in which said shape is generally circular.

17. The assembly of claim 1 further including means for defining said first position.

18. The assembly of claim 17 in which said means for defining includes stop means on at least one of said holster, and said safety strap for engaging said securing device in said first position.

19. The assembly of claim 1 in which said securing device and said means for releasably fastening are operable in distinct directions.

20. The assembly of claim 1 further including means for locking said securing device in said second position to prevent rotation to said first position.

21. A security thumb-break assembly for releasably securing a holster safety strap to a holster, comprising:

an actuating member protruding from the holster pivotable between a substantially vertical position and a partially rotated position;

a snap fastener including a protruding engaging portion and a receiving portion, one of said portions on said actuating member and the other said portion on the safety strap adjacent said actuating member;

said engaging portion including a shank with an enlarged distal end having at least one flattened portion, and said receiving portion including a substantially annular socket having at least one tab protruding inwardly from said socket to allow said engaging portion to engage said socket only when said flattened portion is aligned with said tab, such alignment occurring when said actuating member is in said substantially vertical position so that said fastener may be released with the wearer's thumb; and said tab engaging under said enlarged distal end when said snap fastener is engaged and said actuating member at least partially rotated to inhibit release of said fastener for providing additional security in a holster safety strap.

22. A security safety-strap holster, comprising:

a top-opening holster pocket;

a safety strap having both ends pivotably fastened to opposite sides of said holster pocket pivotable from a first security position spanning said opening to inhibit removal of the handgun from said holster pocket to a second position substantially free of said opening, said safety strap further having an engaging means proximate at least one of the pivotably fastened ends; and means for releasably fastening said engaging means when said safety strap is in said first position to prevent said strap from pivoting to said second position.

23. The holster of claim 22 in which said means for releasably fastening includes a snap member.

24. A security assembly for releasably securing a handgun in a top-opening holster pocket, comprising:

a safety strap having both ends pivotably fastened to opposite sides of said holster pocket pivotable from a first security position spanning said opening to inhibit removal of the handgun from the holster pocket to a second position substantially free of said opening, said safety strap further having an engaging means proximate at least one of the pivotably fastened ends; and means for releasably fastening said engaging means when said safety strap is in said first position to prevent said strap from pivoting to said second position.

* * * * *